US008146395B2

(12) United States Patent
Zhu et al.

(10) Patent No.: US 8,146,395 B2
(45) Date of Patent: Apr. 3, 2012

(54) ANTI-THEFT LOCK WITH PLATE TUMBLERS

(75) Inventors: Changluo Zhu, Pingdingshan (CN); Mu Lin, Pingdingshan (CN)

(73) Assignee: Pingdingshan Dahan Lock Co., Ltd., Zhengzhou, Henan (CN)

( * ) Notice: Subject to any disclaimer, the term of this patent is extended or adjusted under 35 U.S.C. 154(b) by 124 days.

(21) Appl. No.: 12/746,555

(22) PCT Filed: Dec. 4, 2008

(86) PCT No.: PCT/CN2008/073333

§ 371 (c)(1), (2), (4) Date: Jun. 7, 2010

(87) PCT Pub. No.: WO2009/076856

PCT Pub. Date: Jun. 25, 2009

(65) Prior Publication Data

US 2010/0257903 A1 Oct. 14, 2010

(30) Foreign Application Priority Data

Dec. 13, 2007 (CN) ..... 2007 1 0160958

(51) Int. Cl.
*E05B 29/04* (2006.01)

(52) U.S. Cl. ..... 70/375; 70/419; 70/492

(58) Field of Classification Search ..... 70/372, 70/375, 379 R, 379 A, 419, 421, 417, 492, 70/495

See application file for complete search history.

(56) References Cited

U.S. PATENT DOCUMENTS

| | | | | |
|---|---|---|---|---|
| 3,410,123 | A * | 11/1968 | Jacobi | 70/495 |
| 4,195,503 | A * | 4/1980 | Roberts | 70/366 |
| 4,220,021 | A * | 9/1980 | Burger et al. | 70/276 |
| 4,601,184 | A * | 7/1986 | Doinel | 70/360 |
| 4,662,197 | A * | 5/1987 | Tietz et al. | 70/276 |
| 5,070,716 | A * | 12/1991 | Whorlow | 70/492 |
| 6,058,751 | A * | 5/2000 | Dimig et al. | 70/419 |
| 6,439,016 | B1 * | 8/2002 | Wittwer et al. | 70/379 R |
| 6,523,382 | B1 * | 2/2003 | Dimig et al. | 70/496 |
| 6,761,052 | B2 * | 7/2004 | Buschmann | 70/361 |
| 7,634,930 | B2 | 12/2009 | Boesel et al. | |
| 2004/0206142 | A1 * | 10/2004 | Boesel et al. | 70/417 |
| 2005/0217329 | A1 * | 10/2005 | Chang | 70/417 |

FOREIGN PATENT DOCUMENTS

| | | |
|---|---|---|
| CN | 2846636 Y | 12/2006 |
| CN | 201169980 Y | 12/2008 |

* cited by examiner

*Primary Examiner* — Lloyd Gall

(74) *Attorney, Agent, or Firm* — Alan Kamrath; Kamrath IP Lawfirm, PA

(57) ABSTRACT

An anti-theft lock with plate tumblers includes two axial grooves (18) which are disposed at diametrically opposite locations on an inner wall of the lock (1) and an annular groove (10) which has a rectangular cross section and is provided on the inner wall of the lock (1) adjacent an end proximal to a key slot (21). A round controlling plate (8), of which the diameter is same as that of the core (2), is disposed between the lock cover (9) and the lock core (2). A key slot (15), which is narrower than the key slot (21) in the lock core (2), is provided in the round controlling plate (8). Two V-shaped grooves (16) are provided on the inner sidewall of the round controlling plate (8) and correspond to two ends of the key slot (15). Two swallowtail grooves (20), in which a brake shaft (4) is mounted, are provided on the lock core (2), Multiple tooth grooves (17), which are engaged with the brake position teeth (14), are disposed on the outer walls of the two ends of the plate tumblers (5).

4 Claims, 8 Drawing Sheets

ANTI-THEFT LOCK WITH PLATE TUMBLERS

BACKGROUND OF THE INVENTION

1. Field of the Invention

The present invention relates to an anti-theft lock, and more particularly to an anti-theft lock with plate tumblers.

2. Description of Related Art

In the present technology, many kinds of anti-theft locks are provided and substantially include mechanical types and electrical types. A mechanical anti-theft lock may comprise pins or plate tumblers. To keep an anti-theft lock from being unlocked unauthorizedly, multiple sets of pins or plate tumblers at different angles or auxiliary pins or codes may be provided to increase difficulty of unlocking the lock. However, the conventional anti-theft lock can be unlocked by means of controlling the pins or plate tumblers and cannot provide an excellent burglarproofing effect. An electrical anti-theft lock may comprise an identifying system or control system provided with programs but is complicated in structure and at a high cost. Therefore, the conventional electrical anti-theft lock is not widely used in offices, homes, cars or cabinets. Furthermore, the conventional electrical anti-theft lock can also be decoded or unlocked to cause burglary and to threaten the safety of property of life of a user.

SUMMARY OF THE INVENTION

The main objective of the invention is to provide an anti-theft lock with plate tumblers that has a simplified structure at a lowered cost and cannot be unlocked except by a desired key.

To achieve aforementioned objective, an anti-theft lock comprises a lock, a lock core and a lock cover. The lock includes two axial grooves which are disposed at diametrically opposite locations on an inner wall of the lock. A groove has a rectangular cross section and is provided on the inner wall of the lock adjacent an end proximal to a key slot.

The lock core includes multiple rectangular tumbler holes divided by baffles. Each tumbler hole has a spring hole defined in one end of the tumbler hole. A round controlling plate, of which the diameter is same as that of the core, is disposed between the lock cover and the lock core. A key slot is provided in the round controlling plate, and two V-shaped grooves are provided in an inner sidewall of the round controlling plate and correspond to two ends of the key slot.

The lock core has two swallowtail grooves which are disposed at diametrically opposite locations on an outer wall of the lock core. A brake shaft is mounted slidably in one of the swallowtail grooves. The brake shaft has an inner end abutting with a spring and an outer end provided with a boss corresponding to one of the V-shaped grooves in the round controlling plate. A brake block is provided on a curved wall of the brake shaft adjacent to the outer end and corresponds to one of the axial grooves and the groove. Multiple brake position teeth are provided symmetrically on two inner walls of the brake shaft, and each adjacent brake position tooth has a distance from each other equal to a thickness of a plate tumbler.

The round controlling plate has a side corresponding to an inner end of the lock cover and an outer edge corresponding to an inner wall of the lock.

The plate tumbler has a rectangular hole corresponding to a key slot in the lock core. A pressing bar is provided on one side of the plate tumbler and abuts with a spring mounted in one of the spring holes. Multiple tooth grooves are provided on two outer sides of two ends of the plate tumbler and correspond to the brake position teeth.

The key slot in the lock core has a width wider than that of the key slot in the round controlling plate.

The anti-theft lock further comprises a feature of that the brake block has an axial distance to the groove at a locked condition of the anti-theft lock equal to a depth of the V-shaped grooves in the round controlling plate.

The anti-theft lock further comprises a feature of that the axial grooves have a length not smaller than a sum of a thickness of the round controlling plate and a length of the brake shaft.

The anti-theft lock further comprises a feature of that the inner walls of the brake shaft correspond to the plate tumbler and the brake position teeth on the inner walls of the brake shaft have a length equal to a thickness of the baffles.

The Present Invention Has The Following Advantages

1. The round controlling plate is mounted between the lock cover and the lock core, has a diameter equal to that of the lock core and is provided with the V-shaped grooves on two ends of the inner sidewall of the round controlling plate. The axial grooves and the annular groove are defined in the inner wall of the lock, and the brake shafts are mounted on the lock core. When a key is slightly rotated, the brake shafts are moved inward to engage the brake position teeth on the brake shafts with the tooth grooves in the unlocked plate tumblers. The brake blocks are moved to align with the annular groove, and the anti-theft lock is unlocked when the key is further rotating. However, if the round controlling plate is rotated without a desired key, the brake shafts are moved inward to make the brake position teeth engaging the tooth grooves on the locked plate tumblers. Consequently, the plate tumblers are held in the axial grooves and kept at the locked condition, and the anti-theft lock cannot be unlocked. If the round controlling plate is not rotated but the plate tumblers are unlocked, the anti-theft lock cannot be unlocked because the brake blocks are still held in the axial grooves and are not moved to align with the annular groove. Accordingly, the anti-theft lock cannot be unlocked without a desired key, and a dual and excellent burglarproofing effect is provided and the structure of the anti-theft lock can be simplified.

2. With the width of the key slot in the lock core being larger than that of the key slot in the round controlling plate, the brake shafts can hold the plate tumblers at locked conditions to achieve a burglarproofing effect.

3. The swallowtail grooves are disposed at diametrically opposite locations on an outer wall of the lock core and correspond to the tumbler holes. The brake shafts are mounted slidably in the swallowtail grooves and the inner ends of the brake shafts abut with the springs. The bosses are provided on the outer ends of the brake shafts and correspond to the V-shaped grooves in the round controlling plate. Accordingly, the brake shafts are slidable in the swallowtail grooves by the round controlling plate, and the anti-theft lock is easily locked or unlocked.

4. The brake shafts have multiple brake position teeth formed on the inner walls, and each adjacent brake position teeth have a distance from each other equal to a thickness of a plate tumbler. The brake shafts can engage the tooth grooves in the plate tumbler when the brake shafts are slightly moved to improve the burglarproofing effect.

5. With the tooth grooves provided on the outer sides of two ends of the plate tumblers, the plate tumblers can be securely held with the brake shafts to keep the plate tumblers from moving. Thus, the anti-theft lock can be kept at the locked condition firmly.

The round controlling plate of the present invention can control the brake shafts engaging the plate tumblers to achieve the locked or unlocked objective. This can prevent the anti-theft lock being unauthorizedly unlocked with widely used ways, and an excellent burglarproofing effect is provided. The anti-theft lock can be applied on offices, homes, cars, motorcycles, cases or cabinets, has a simplified structure and an excellent burglarproofing effect, is easily manufactured and is versatile in use.

Other objects, advantages and novel features of the invention will become more apparent from the following detailed description when taken in conjunction with the accompanying drawings.

Figure 1:
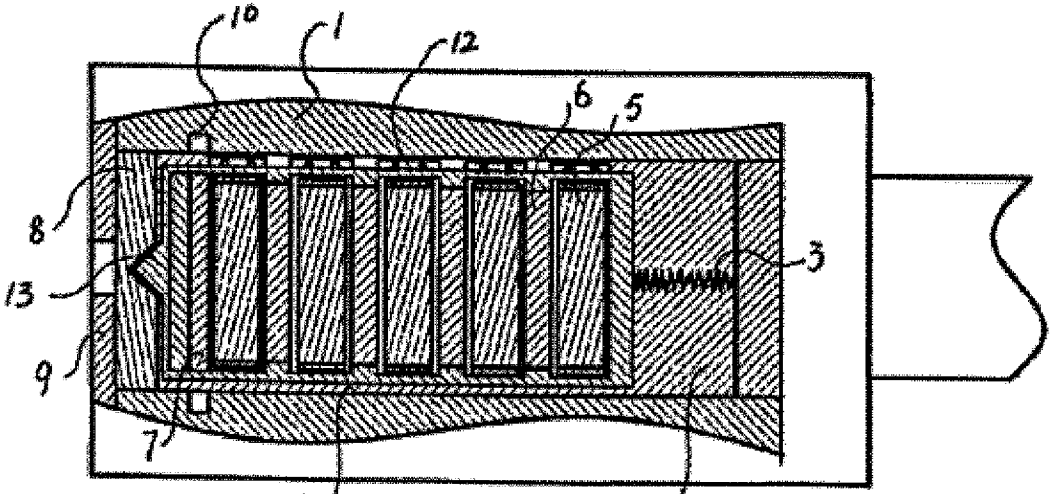
FIG. 1 is a front view of the present invention.
Figure 2:
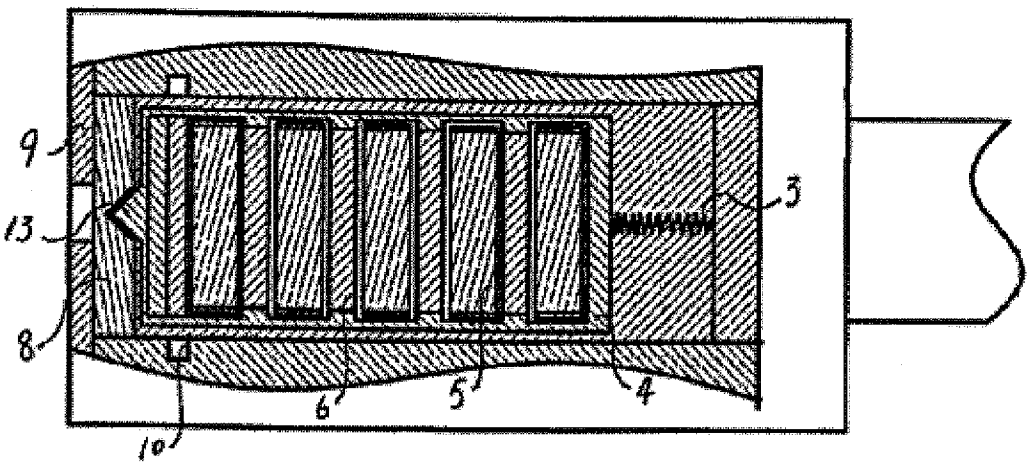
FIG. 2 is a rear view of the present invention.
Figure 4:
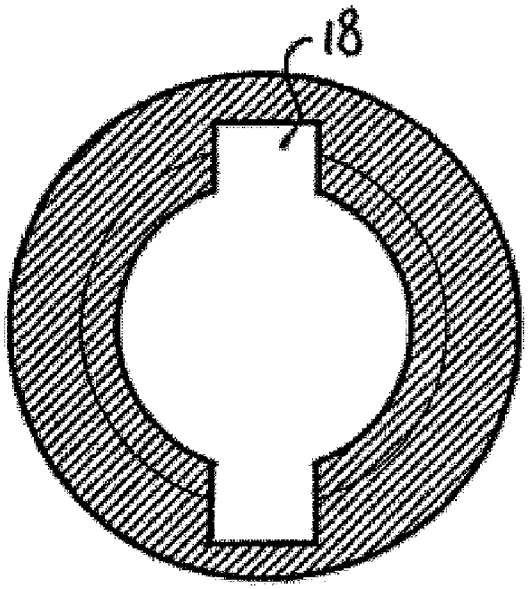
FIG. 4 is a cross sectional end view of the lock of the present invention.
Figure 3:
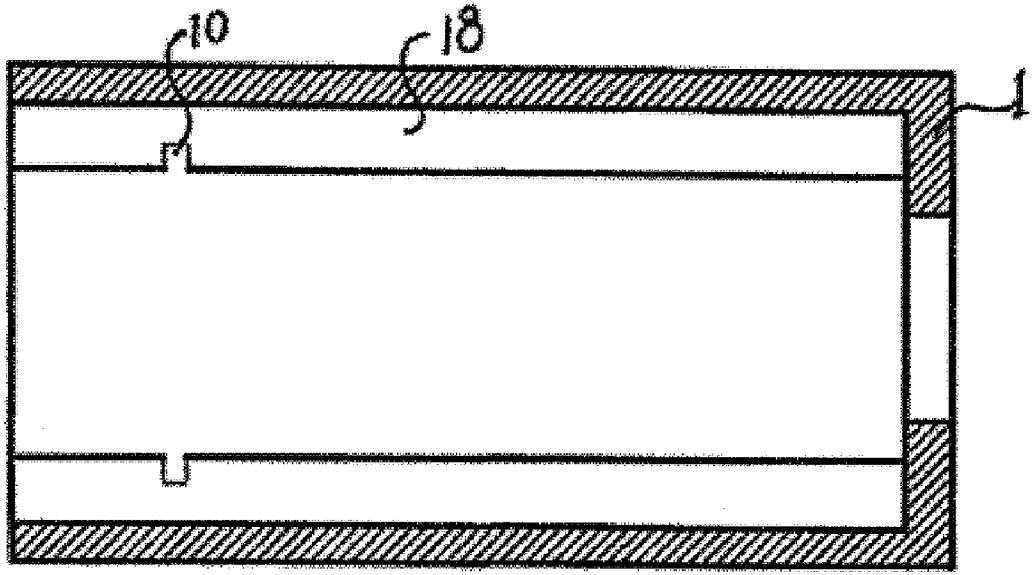
FIG. 3 is a cross sectional side view of a lock of the present invention.
Figure 7:
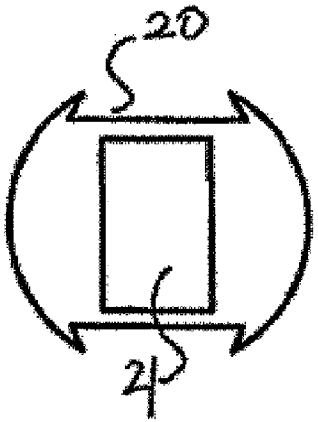
FIG. 7 is a rear view of the lock core of the present invention.
Figure 5:
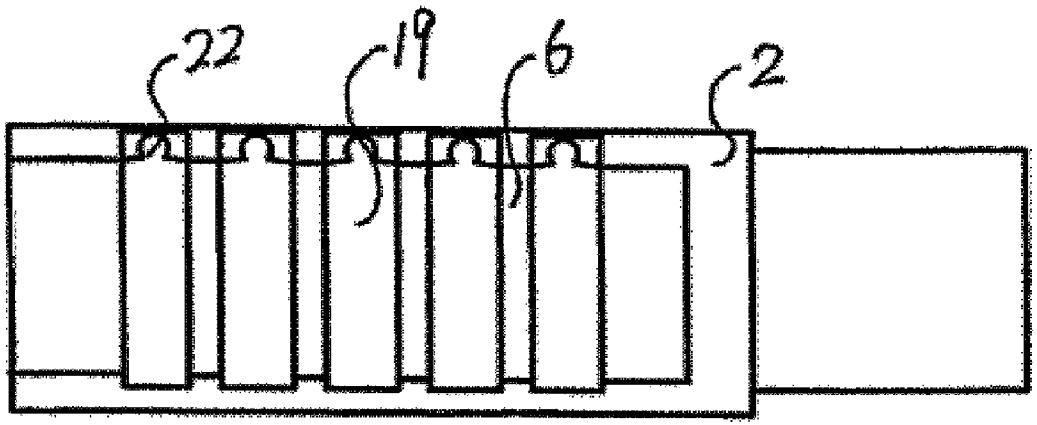
FIG. 5 is a front view of a lock core of the present invention.
Figure 6:
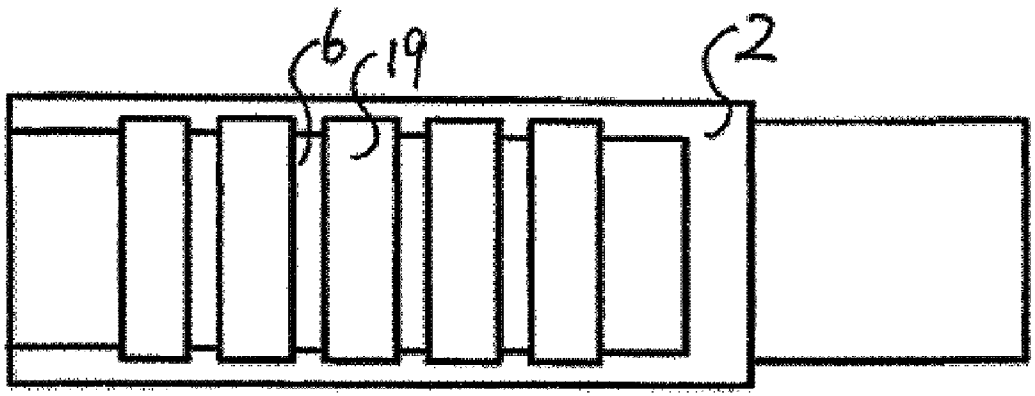
FIG. 6 is a left side view of the lock core in FIG. 5.
Figure 9:
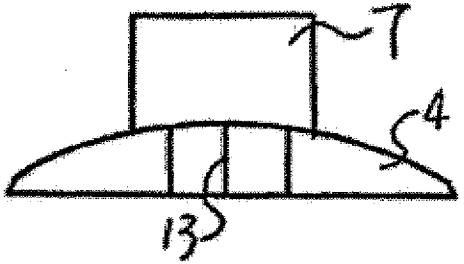
FIG. 9 is a left side view of the brake shaft in FIG. 8.
Figure 11:
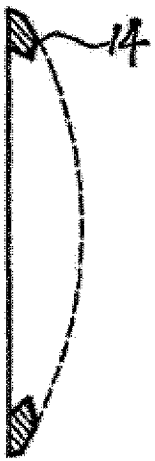
FIG. 11 is a cross sectional side view of the brake shaft.
Figure 8:
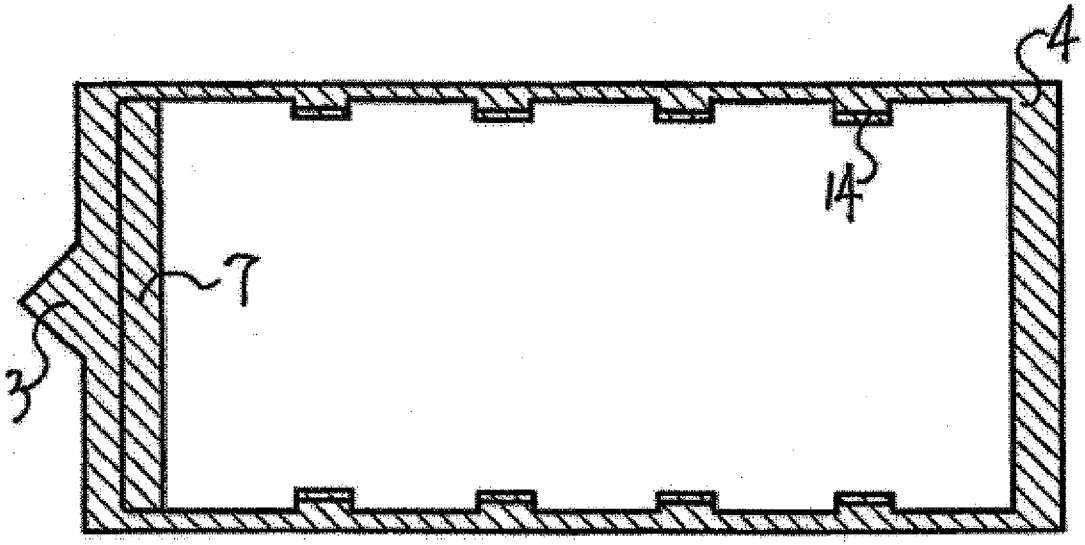
FIG. 8 is a front view of a brake shaft of the present invention.
Figure 10:
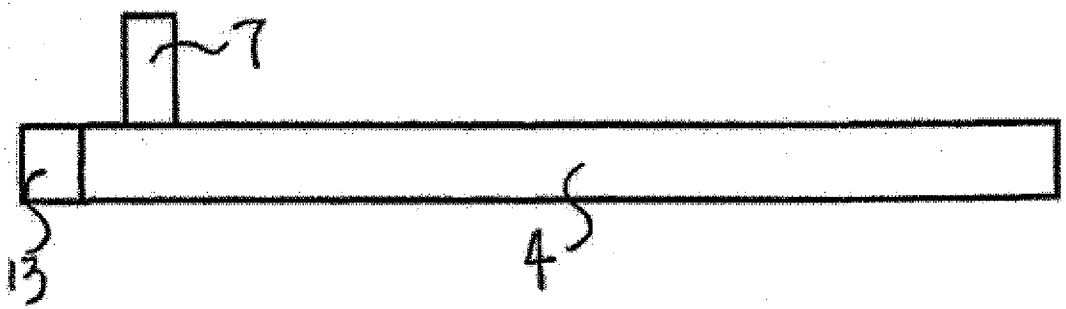
FIG. 10 is a bottom view of the brake shaft in FIG. 8.
Figure 12:
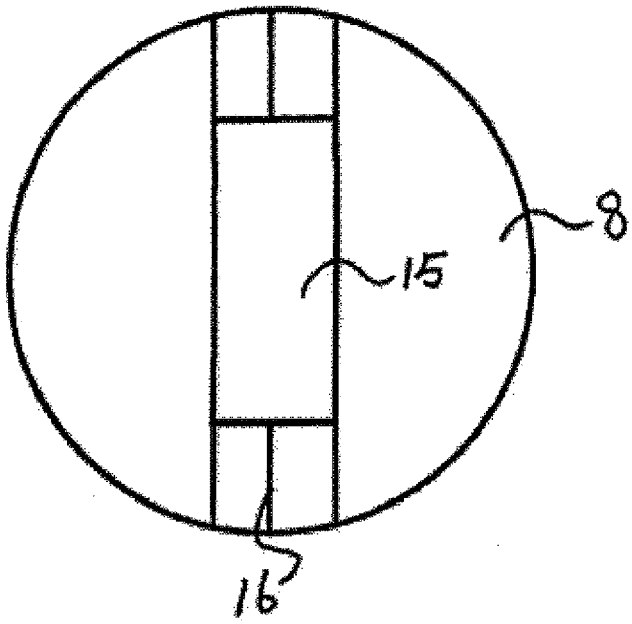
FIG. 12 is a front view of a round controlling plate of the present invention.
Figure 13:
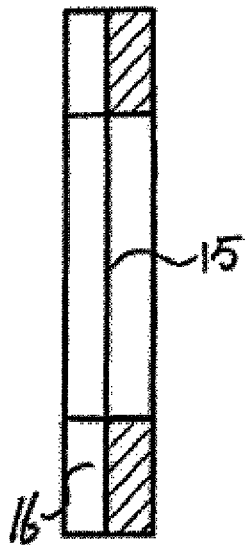
FIG. 13 is a cross sectional side view of the round controlling plate in FIG. 12.
Figure 14:
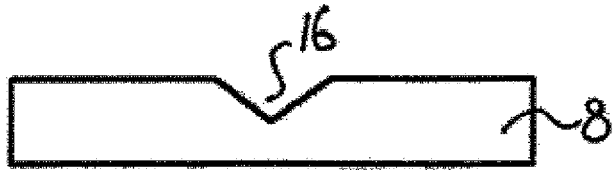
FIG. 14 is a top view of the round controlling plate in FIG. 12.
Figure 15:
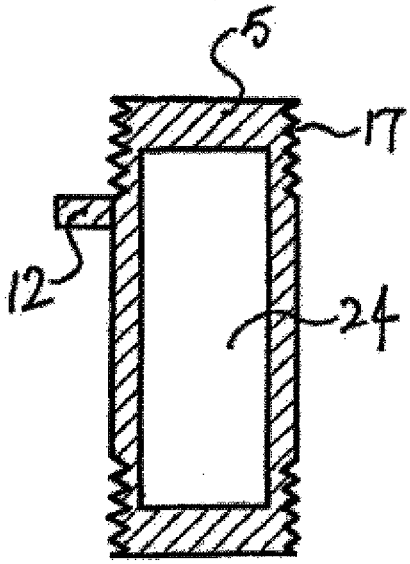
FIG. 15 a front view of a plate tumbler of the present invention.
Figure 16:
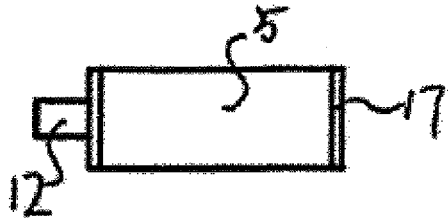
FIG. 16 is a top view of the plate tumbler in FIG. 15.

List of referenced numbers: 1-lock, 2-lock core, 3-spring, 4-brake shaft, 5-plate tumbler, 6-baffle, 7-brake block, 8-round controlling plate, 9-lock cover, 10-annular groove, 12-pressing bar, 13-boss, 14-brake position tooth, 15-key slot, 16-V-shaped groove, 17-tooth groove, 18-axial groove, 19-tumbler hole, 20-swallowtail groove, 21-key slot, 22-spring hole, 23-spring and 24-rectangular hole.

DETAILED DESCRIPTION OF PREFERRED EMBODIMENT

With reference to FIGS. 1 to 16 and 19, an anti-theft lock comprises a lock 1, a lock core 2 and a lock cover 9. The lock 1 includes two axial grooves 18 which are disposed at diametrically opposite locations on an inner wall of the lock 1. An annular groove 10 has a rectangular cross section and is provided on the inner wall of the lock 1 adjacent an end proximal to a key slot.

The lock core 2 includes multiple rectangular tumbler holes 19 divided by baffles 6. Each tumbler hole 19 has a spring hole 22 defined in one end of the tumbler hole 19. A round controlling plate 8, of which the diameter is same as that of the core 2, is disposed between the lock cover 9 and the lock core 2. A key slot 15 is provided in the round controlling plate 8. Two V-shaped grooves 16 are provided in an inner sidewall of the round controlling plate 8 and correspond to two ends of the key slot 15.

The lock core 2 has two swallowtail grooves 20 which are disposed at diametrically opposite locations on an outer wall of the lock core 20. A brake shaft 4 is mounted slidably in one of the swallowtail grooves 20 and has an inner end abutting with a spring 3 and an outer end provided with a boss 13 corresponding to one of the V-shaped grooves 16 in the round controlling plate 8. A brake block 7 is provided on a curved wall of the brake shaft 4 adjacent to the outer end and corresponds to one of the axial grooves 18 and the annular groove 10. Multiple brake position teeth 14 are provided symmetrically on two inner walls of the brake shaft 4, and each adjacent brake position tooth 14 have a distance from each other equal to a thickness of a plate tumbler 5. The round controlling plate 8 has a side corresponding to an inner end of the lock cover 9 and an outer edge corresponding to an inner wall of the lock 1.

Each plate tumbler 5 has a rectangular hole 24 corresponding to a key slot 21 in the lock core. A pressing bar 12 is provided on one side of the plate tumbler 5 and abuts with a spring 23 mounted in one of the spring holes 22. Multiple tooth grooves 17 are provided on two outer sides of two ends of the plate tumbler 5 and correspond to the brake position teeth 14. The key slot 21 in the lock core 2 has a width wider than that of the key slot 15 in the round controlling plate 8.

The brake block 7 has an axial distance to the annular groove 10 at a locked condition of the anti-theft lock equal to a depth of the V-shaped grooves 16 in the round controlling plate 8.

The axial grooves 18 in the inner wall of the lock 1 have a length not smaller than a sum of a thickness of the round controlling plate 8 and a length of the brake shaft 4.

The inner walls of the brake shaft 4 correspond to the plate tumblers, and the brake position teeth 14 on the inner walls of the brake shaft 4 have a length equal to a thickness of the baffles 6.

Figure 17:
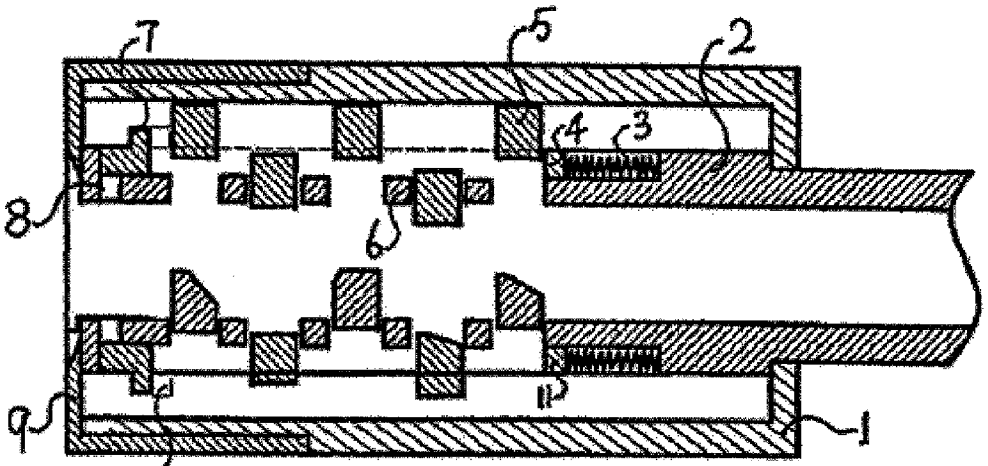
FIG. 17 is a cross sectional side view of the present invention at a locked condition.
Figure 19:
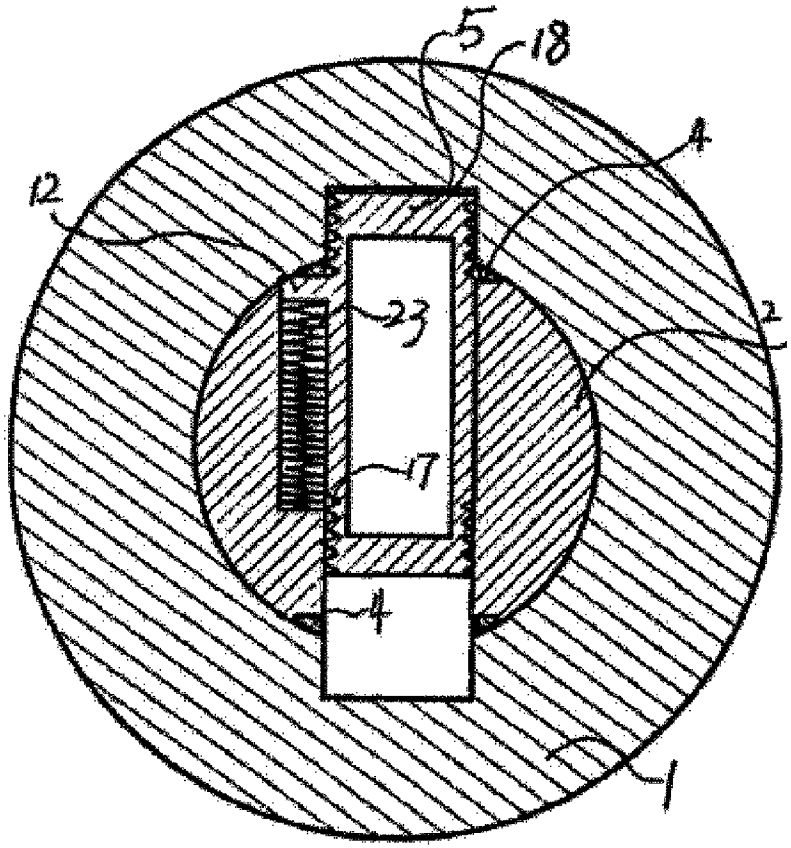
FIG. 19 is a cross sectional end view of the present invention in FIG. 17.

With reference to FIGS. 17 and 19, when the anti-theft lock is at a locked condition, the brake blocks 7 on the brake shafts 4 and the plate tumblers are held in the axial grooves. The bosses on the brake shafts 4 are held in the V-shaped grooves 16 in the round controlling plate 8, and the tooth grooves 17 in the plate tumblers 5 are separated from the brake position teeth 14 on the inner walls of the brake shafts 4. If the round controlling plate 8 is rotated without inserting a desired key, the lock core 2 is kept stationary with the round controlling plate 9 idly rotating due to that the width of the key slot 22 in the lock core 2 is larger than that of the key slot 15 in the round controlling plate 8. At this time, the brake shafts 4 are pushed to move with the V-shaped grooves 16 pushing against the brake blocks 13 to make the brake position teeth 14 on the brake shafts 4 engaging the tooth grooves in the plate tumblers 5 that are at the locked condition. Accordingly, the plate tumblers 5 are held in the axial grooves 18, and the lock core 2 is kept from being rotated and the anti-theft lock cannot be unlocked. Because the brake blocks 7 are held in the axial grooves 18 and are not moved to align the annular groove 10, the anti-theft lock cannot be unlocked even that the plate tumblers 5 are forced to escape from the axial grooves 18.

If the plate tumblers 5 are forced to escape from the axial grooves 18 firstly and the round controlling plate 8 is then rotated, the anti-theft lock is kept from being unlocked because the round controlling plate 8 is in misalignment with the key slot 21 and the brake blocks cannot be moved to align with the annular groove 10.

Figure 18:
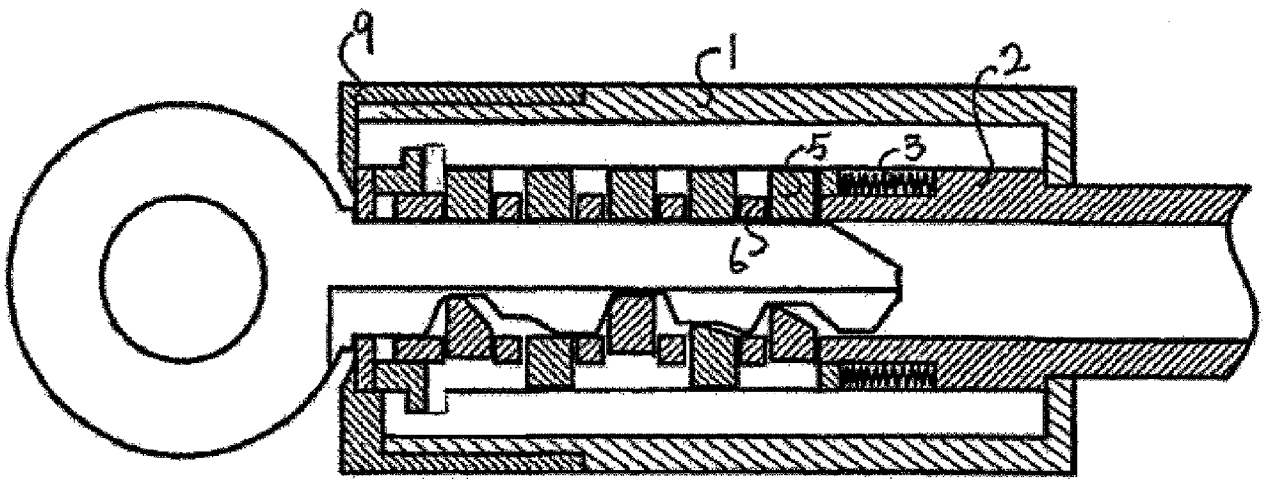
FIG. 18 is an operational cross sectional side view of the present invention with a key inserting thereinto.
Figure 20:
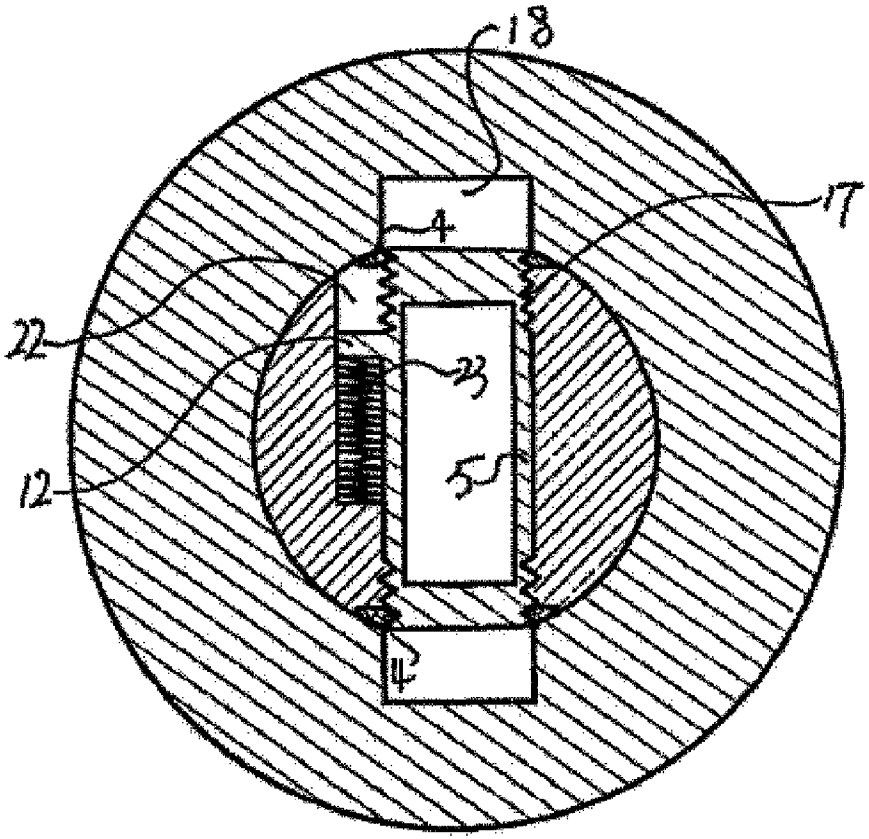
FIG. 20 is a cross sectional end view of the present invention in FIG. 18.
Figure 21:
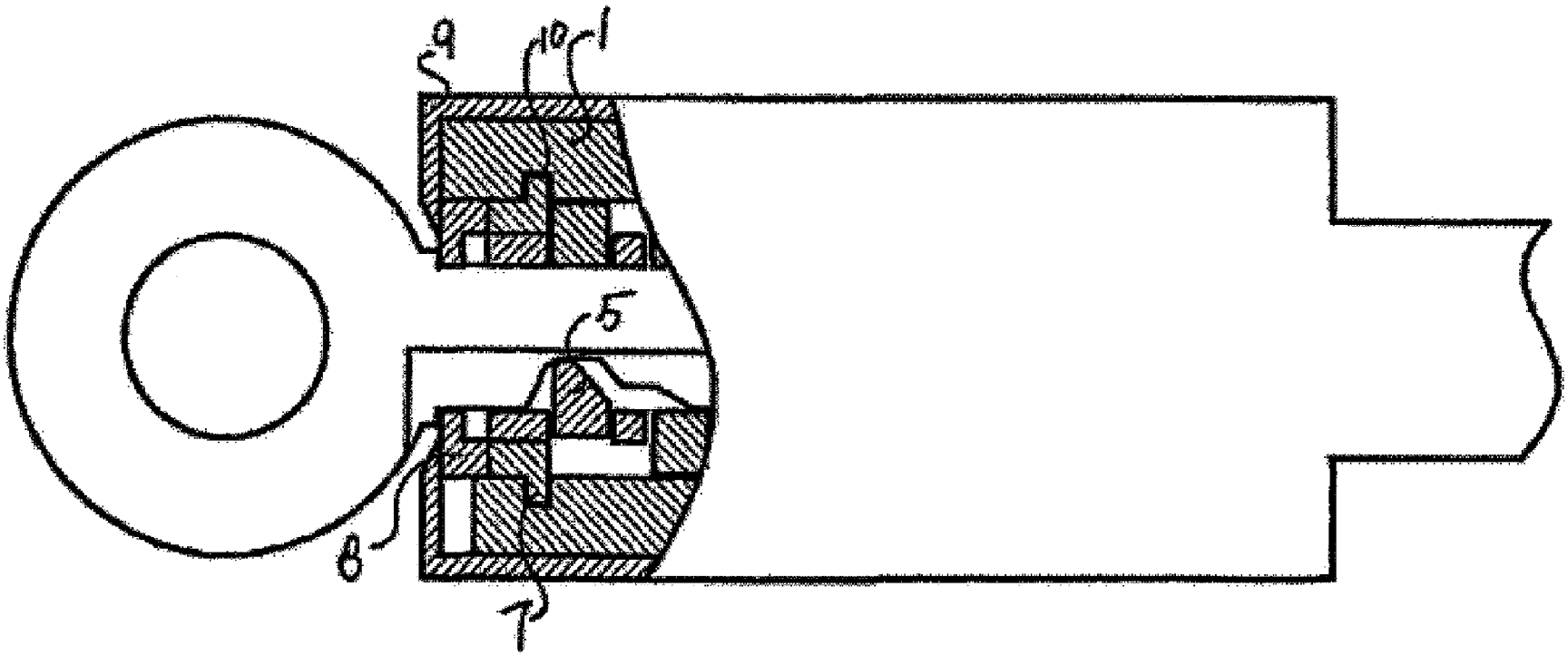
FIG. 21 an operational cross sectional side view of the present invention at an unlocked condition.

With reference to FIGS. 18, 20 and 21, to unlock the anti-theft lock, a desired key is inserted into the key slot and the plate tumblers 5 are all retracted into the lock core 2. At this time, the key is turned and the round controlling plate 8 is rotated with the key. Because the width of the key slot 21 in the lock core 2 is larger than that of the key slot 15 in the round controlling plate 8, the round controlling plate 8 can idly rotate and the lock core keeps stationary. The brake shafts 4 will be moved with the V-shaped grooves pushing against the bosses 13 to make the brake position teeth 14 on the brake shafts 4 engaging the tooth grooves 17 in the plate tumblers 5. With the key being further rotated, the bosses 13 will be pushed completely out from the V-shaped grooves 16. Consequently, the brake blocks 7 can be moved to align with the annular groove 10 because the brake blocks 7 have an axial distance to the annular groove 10 at a locked condition of the anti-theft lock equal to the depth of the V-shaped grooves 16 in the round controlling plate 8. The lock core 2 can be rotated to unlock the anti-theft lock with the engagement between the swallowtail grooves 20 and the brake shafts 4 when key is further rotating.

After the anti-theft lock being unlocked and the key is removed, the springs 3 will push the brake shafts 4 moving outward to make the bosses 13 on the brake shafts 4 engaging the V-shaped grooves 16. The brake position teeth 14 on the brake shafts 4 will disengage from the tooth grooves 17 in the plate tumblers 5, and the plate tumblers 5 will be pushed into the axial grooves 18 with the forces provided by the springs 23 to lock the anti-theft lock.

What is claimed is:

1. An anti-theft lock comprising a lock (1), a lock core (2) and a lock cover (9), and characterized in that the lock (1) includes two axial grooves (18) which are disposed at diametrically opposite locations on an inner wall of the lock (1) and an annular groove (10) which has a rectangular cross section and is provided on the inner wall of the lock (1) adjacent an end proximal to a key slot;

the lock core (2) includes multiple rectangular tumbler holes (19) divided by baffles (6), each tumbler hole (19) has a spring hole (22) defined in one end of the tumbler hole (19), a round controlling plate (8), of which the diameter is the same as that of the core (2), is disposed between the lock cover (9) and the lock core (2), a key slot (15) is provided in the round controlling plate (8) and two V-shaped grooves (16) are provided in an inner sidewall of the round controlling plate (8) and correspond to two ends of the key slot (15);

the lock core (20) has two swallowtail grooves (20) which are disposed at diametrically opposite locations on an outer wall of the lock core (20), a brake shaft (4) is mounted slidably in one of the swallowtail grooves (20), the brake shaft (4) has an inner end abutting with a spring (3), an outer end provided with a boss (13) corresponding to one of the V-shaped grooves (16) in the round controlling plate (8), a brake block (7) provided on a curved wall of the brake shaft (4) adjacent to the outer end and corresponding to one of the axial grooves (18) and the annular groove (10) and multiple brake position teeth (14) provided symmetrically on two inner walls of the brake shaft (4), wherein each adjacent brake position teeth (14) has a distance from each other equal to a thickness of a plate tumbler (5);

the round controlling plate (8) has a side corresponding to an inner end of the lock cover (9) and an outer edge corresponding to an inner wall of the lock (1);

the plate tumbler (5) has a rectangular hole (24) corresponding to a key slot (21) in the lock core, a pressing bar (12) provided on one side of the plate tumbler (5) and abutting with a spring (23) mounted in one of the spring holes (22) and multiple tooth grooves (17) provided on two outer sides of two ends of the plate tumbler (5) and corresponding to the brake position teeth (14);

the key slot (21) in the lock core (2) has a width wider than that of the key slot (15) in the round controlling plate (8).

2. The anti-theft lock as claimed in claim 1, wherein the brake block (7) on the brake shaft (4) has an axial distance to the annular groove (10) at a locked condition of the anti-theft lock equal to a depth of the V-shaped grooves (16) in the round controlling plate (8).

3. The anti-theft lock as claimed in claim 1, wherein the axial grooves (18) have a length not smaller than a sum of a thickness of the round controlling plate (8) and a length of the brake shaft (4).

4. The anti-theft lock as claimed in claim 1, wherein the inner walls of the brake shaft (4) correspond to the plate tumbler, and the brake position teeth (14) on the inner walls of the brake shaft (4) have a length equal to a thickness of the baffles (6).

* * * * *